United States Patent [19]

Mahan et al.

[11] 4,334,136

[45] Jun. 8, 1982

[54] MICROWAVE TREATING MECHANISM

[75] Inventors: Douglas P. Mahan, 1510 NE. 72nd Ave., Portland, Oreg. 97213; Richard E. Skinner; Robert A. McClanathan, both of Portland, Oreg.

[73] Assignee: Douglas P. Mahan, Portland, Oreg.

[21] Appl. No.: 80,665

[22] Filed: Oct. 1, 1979

[51] Int. Cl.[3] ..... H05B 6/68; F26B 11/02

[52] U.S. Cl. ..... 219/10.55 B; 219/10.55 R; 219/10.55 D; 219/10.55 C; 34/1; 34/135

[58] Field of Search ..... 219/10.55 R, 10.55 A, 219/10.55 B, 10.55 M, 10.55 F, 10.55 C, 10.55 D, 10.55 E, 389, 518; 335/205; 34/1, 4, 135–137; 432/103; 200/85 R, 61.62, 61.83

[56] References Cited

U.S. PATENT DOCUMENTS

| | | | |
|---|---|---|---|
| 2,273,904 | 2/1942 | Smith | 219/518 |
| 3,410,116 | 11/1968 | Levinson | 219/10.55 R X |
| 3,439,431 | 4/1969 | Heidtmann | 219/10.55 B X |
| 3,461,401 | 8/1969 | Williams | 219/10.55 B X |
| 3,470,942 | 10/1969 | Fukada et al. | 219/10.55 B |
| 3,496,500 | 2/1970 | Romary | 335/205 |
| 3,529,115 | 9/1970 | Jawor | 219/10.55 A |
| 3,605,272 | 9/1971 | Boucher | 219/10.55 A X |
| 3,627,959 | 12/1971 | Chapell | 219/10.55 C X |
| 3,678,238 | 7/1972 | Yasuoka et al. | 219/10.55 D |
| 3,789,179 | 1/1974 | Haagensen | 219/10.55 F |
| 3,936,622 | 2/1976 | McElroy | 200/85 R |
| 4,009,359 | 2/1977 | Tallmadge | 219/10.55 B |
| 4,087,921 | 5/1978 | Blok | 34/1 |
| 4,097,707 | 6/1978 | Kobayashi | 219/10.55 B |
| 4,131,779 | 12/1978 | Tatsukawa et al. | 219/10.55 R |
| 4,207,452 | 6/1980 | Arai | 219/10.55 R |
| 4,210,795 | 7/1980 | Lentz | 219/10.55 B |

*Primary Examiner*—B. A. Reynolds
*Assistant Examiner*—Philip H. Leung
*Attorney, Agent, or Firm*—Eugene M. Eckelman

[57] ABSTRACT

A housing rotatably supports a hollow drum on substantially a horizontal axis whereby articles to be treated tumble around the interior of the drum when the latter is rotated. A microwave power mechanism, such as a magnetron, is provided in a door for the housing and has an output portion thereof directed into the drum for heating and drying articles tumbling in the drum. An output portion of the microwave power mechanism has a dielectric dome-like shield mounted over it for deflecting tumbling articles away from such output. A forced air system is provided for ventilating the interior of the drum, and such system includes a passageway extending adjacent to the power mechanism so that such ventilating air also cools the power means. The present mechanism is associated with an electrical circuit having door interlocks, door panel interlocks, and other interlocks, as well as a magnetically operated door interlock that is substantially foolproof so that power from the microwave power mechanism is positively deenergized when the door is open. Circuitry is provided for the microwave power mechanism to protect it from excess average and peak reflected power. The circuitry also includes a humidity sensor to prevent excessive drying.

7 Claims, 9 Drawing Figures

MICROWAVE TREATING MECHANISM

FIELD OF THE INVENTION

This invention relates to new and useful improvements in microwave treating mechanisms and pertains particularly to such a treating mechanism as applied in association with a hollow drum which is rotatably driven on substantially a horizontal axis and which is arranged to receive and tumble articles to be dried.

SUMMARY OF THE INVENTION

According to the present invention and forming a primary objective thereof, a microwave treating mechanism is provided that employs a novel concept of using microwave power as a drying and heating medium.

A more particular object of the invention is to provide a mechanism of the type described that utilizes a hollow drum which is rotatably supported on substantially a horizontal axis and which is arranged to tumble articles therearound while being treated with the microwave power.

Another object of the invention is to provide a novel forced air system which serves both to ventilate articles being tumbled as well as to cool the microwave power means.

Another object is to provide a novel output for the microwave power means which is arranged to protect such power means from tumbling articles as well as from abnormal reflected power.

Other objects of the invention are to provide circuit elements in the circuit to the power means arranged to protect the power means from excessive average reflected or peak VSWR; to provide humidity sensing means arranged to turn off the power means at a selected dried condition of the articles being treated; and to provide other safety features which include a foolproof magnetically operated door switch that turns off the power to the microwave power means when the door is opened, and means arranged to turn off such power means if the article receiving drum should accidentally be subjected to an abnormal weight.

The invention will be better understood and additional objects and advantages will become apparent from the following description taken in connection with the accompanying drawings.

DETAILED DESCRIPTION OF PREFERRED EMBODIMENTS

Figure 2:
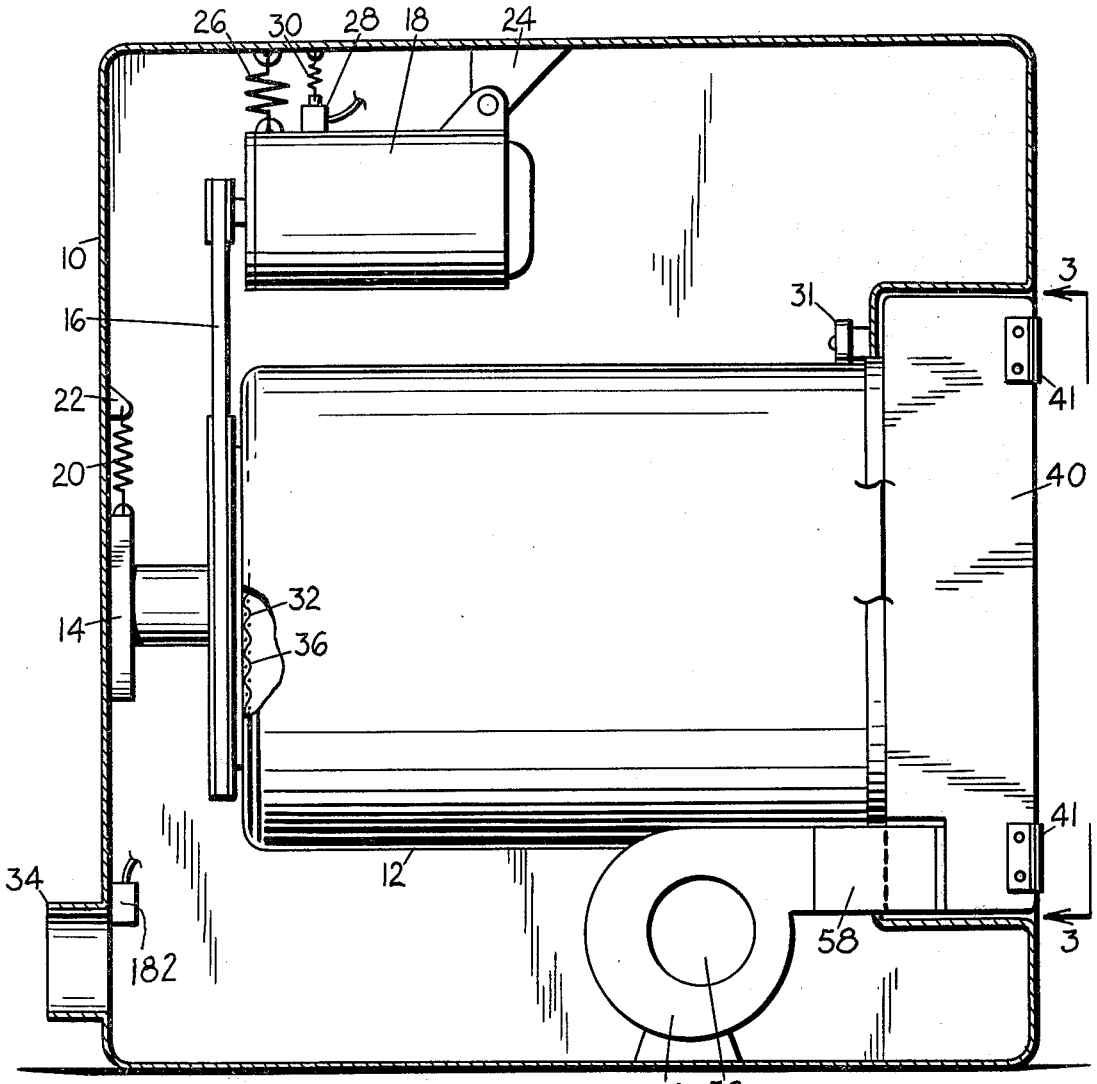
FIG. 2 is an enlarged vertical sectional view of the apparatus taken on line 2—2 of FIG. 1.

With particular reference to the drawings, and first to FIGS. 1–7, one particular application of the present microwave treating mechanism is illustrated. One such application comprises the association of microwave power means for heating and drying articles being tumbled in a rotating drum, such as in association with clothes dryer mechanism using a tumbler as in present day use. The mechanism comprises a housing 10 or other support means having a hollow drum or tumbler 12 supported therein on substantially a horizontal axis. As best seen in FIG. 2, such drum is supported for rotation on a rear bearing assembly 14 supported in the housing. The drum is driven by a belt and pulley assembly 16 associated with a drive motor 18. A feature of the invention is a spring suspension support for the bearing means 14, such as by one or more equally spaced tension or compression springs 20, secured to support brackets 22 on the housing, as well as a pivot support 24 at one end of the motor and a tension spring support 26 at the other end. Motor 18 has a switch housing 28 secured thereto having a spring held contact assembly 30 connected at its other end to the housing 10. The spring suspension of the bearing 14 and the motor 18, as well as the spring contact assembly 30, is arranged such that if an abnormal load should be present in the drum 12, such as an overload of articles or if a child should crawl into the drum, switch 28 will open the circuit to power means to be described. The front of the drum has suitable rotatable support in the housing such as by a plurality of bearing mounted rollers 31.

The rear of the drum 12 has an opening 32 through which air used to ventilate articles within the drum can flow out and be discharged through a rear outlet 34. Rear opening 32 is covered by a screen 36 to prevent or reduce leakage of microwave power from the drum to the door housing.

Housing 10 has a loading door 40 supported by hinges 41. Such door has a substantial thickness between its front panel 42 and its rear panel 44 so as to enclose microwave power means 46, such as a magnetron, supported on a base plate 48 disposed above the bottom of the door and contained within an enclosure 50 forming an enclosed area for the magnetron in combination with the front and rear panels of the door as well as with one side of the door.

A blower 54 having an inlet 56 is mounted adjacent to the bottom of the housing 10 and has an outlet 58 communicating with the enclosure 50 when the door 40 of the mechanism is closed. Rear panel 44 of the door has an outlet opening 60 within the enclosure 50 communicating with the open end of the drum 12. By operation of the blower 54, air is arranged to be circulated through the housing 50, into the drum 12, and out the outlets 32 and 34. Opening 60 preferably is covered by a screen material 62 to prevent or reduce leakage of microwave power from the drum to the door housing. Magnetron 46 preferably has cooling fins 64 to achieve maximum cooling from the air flowing through the enclosure 50. Since the forced air system for ventilating the drum 12 also moves past the magnetron 46 for cooling the latter, such forced air serves a dual purpose.

Figure 5:
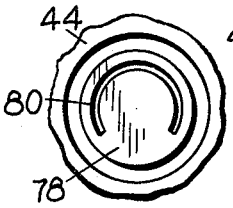
FIG. 5 is a fragmentary end elevational view taken on the line 5—5 of FIG. 4.

Magnetron 46 has an output dome 70, and according to the present invention, such output dome is associated with a transition section 72 of coaxial line which in turn leads to a directional coupler 74 in turn connected to a three stub coaxial tuner 76 which acts as a matching section between the coaxial line portion of the system and a cylindrical wave guide 78 the rearward end of which, FIG. 5, is provided with a horseshoe shaped slot 80. Slot 80 acts as a slot-type antenna and serves as a coupler between the wave guide 78 and the cavity or space formed by the drum. One feature of the wave path 72, 74 and 76 is that such path is elongated so as to get good wave distribution as well as to lessen the possibility of reflected wave damage to the magnetron 46.

Figure 4:
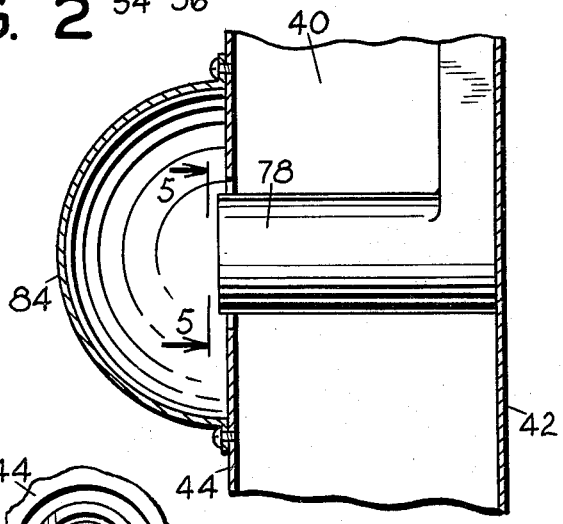
FIG. 4 is a vertical fragmentary sectional view taken on the line 4—4 of FIG. 3.

With reference to FIG. 4, a feature of the invention also resides in the provision of a dome-like shield 84 of dielectric material secured on the rear panel 44 of the door over the end of the cylindrical wave guide 78. This shield serves to protect the end of the wave guide physically from tumbling articles in the drum and also serves to space tumbling articles from such wave guide so as to keep objects a minimum wave length distance away from the microwave coupler and thus out of the coupler's near field. Such prevents perturbations of the near field by articles in the dryer from providing increases in the average reflected power or voltage standing wave ratio which may be damaging to the magnetron. The shield 84 can be of any shape, it being preferred that the shape used provide a minimum spacing from articles in the drum to the coupler of at least one half to one wave length. It is preferred that the shield 84 have a sealed fit with the wall 44 so as to protect the coupler from dirt and moisture.

Figure 6:
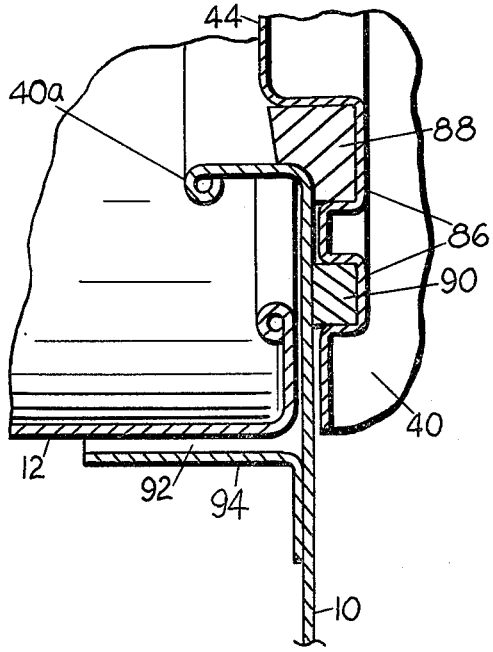
FIG. 6 is an enlarged fragmentary sectional view taken on the line 6—6 of FIG. 3.

With reference to FIG. 6, the inner panel 44 of the door has inwardly facing edge sockets 86 for receiving first a rubber gasket 88 or the like to provide a tight seal with the housing 10 at the door opening 40*a* of the housing and second an RF gasket 90 which serves to protect the outflow of power from the tumbler. A further choke for the outflow of power is provided by an air space 92 formed between an annular baffle 94 secured to the inner surface of the housing 10 and extending parallel with the drum surface.

In addition to known interlocks, it is desired that a substantially foolproof interlock be provided so that the power will not likely be on at any time that the door is open. For this purpose, and with reference to FIGS. 3 and 7, a switch housing 100 is mounted on the rear door panel 44 and encloses a reed switch 102 in the main circuit to the magnetron. Disposed adjacent to the reed switch 102 within the switch housing 100 is a socket 104 that opens through the panel 44. Associated with the socket 104 is a magnet 106 secured on the front wall of the housing 10 whereby with the reed switch 102 being constructed of magnetically actuatable material, and in an arrangement wherein such switch will normally be open but will close upon entrance of the magnet in the socket 104, the main circuit to the power means will open as soon as the door is opened. In order to provide a foolproof arrangement, it is preferred that the socket 104 and the projecting magnet 106 have a substantially exclusive interfitting relation such as a triangular cross section or other shape which would be difficult to match. In addition, this arrangement of door interlock can also have a magnetic power relation such that the magnet must be of a selected power to actuate the reed switch. This would add even a greater foolproof arrangement for the power circuit.

Figure 8:
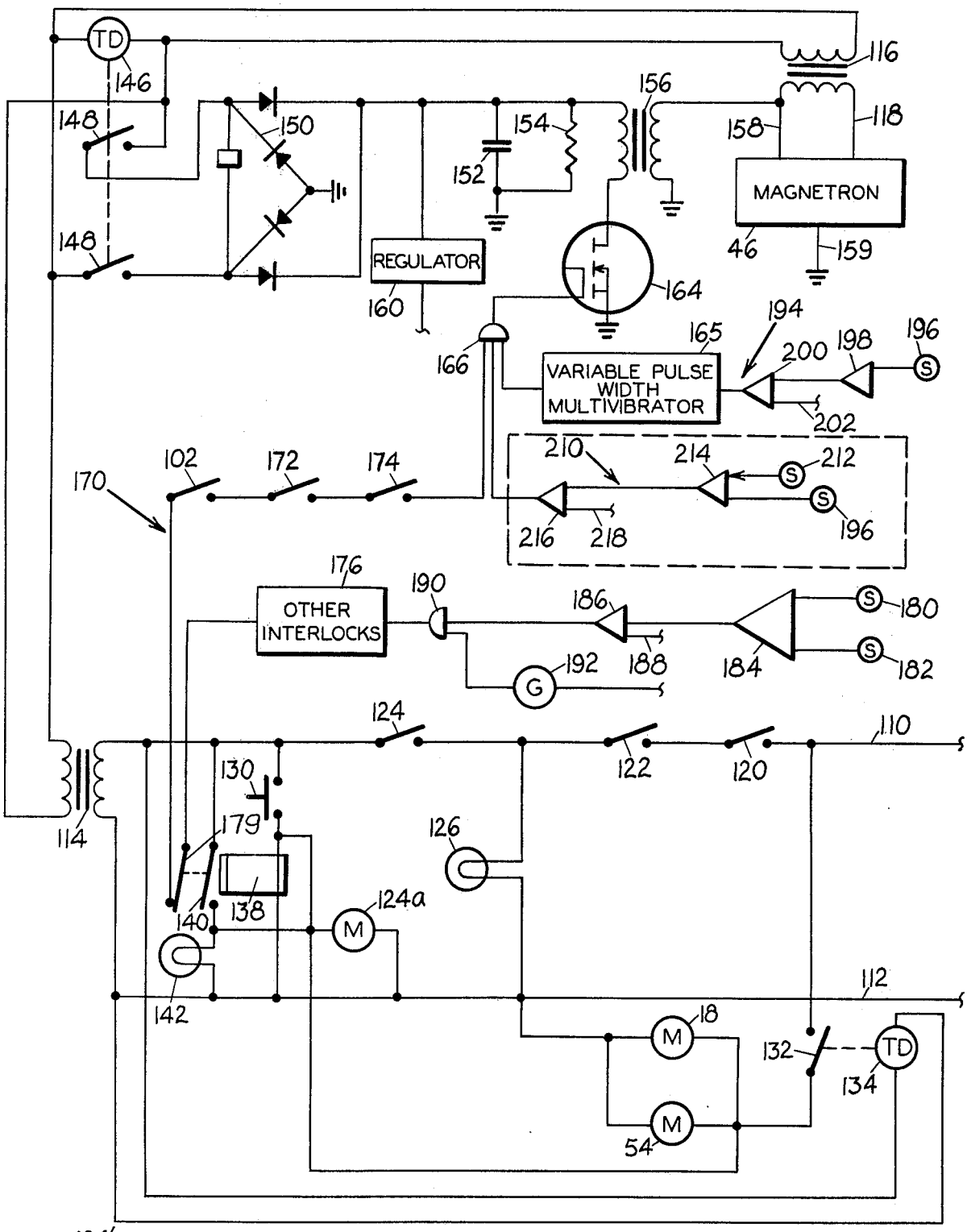
FIG. 8 is a schematic view of electrical circuitry associated with the present mechanism.

Reference is now made to FIG. 8 which shows circuitry for the dryer. Such circuitry includes infeed lines 110 and 112 providing power to an auto/isolation transformer 114 in turn supplying power to a transformer 116 for the filament 118 of the magnetron 46. Infeed line 110 includes a main switch 120, a control panel interlock switch 122, and a timer switch 124. A power indicating lamp 126 is connected in parallel across the infeed lines. Blower motor 54 and drum motor 18 are in circuit with a start switch 130 also including a time delay switch 132 the control device 134 of which is connected across the primary of transformer 114.

A latching relay 138 is connected in series with the start switch 130. The energization of relay 138 closes a contact 140 thereof which latches said relay and continues the supply of power to a drive motor 124*a* for the timer 124. An indicating lamp 142 is connected in the timer circuit.

In the operation of the circuit thus far described, the timer 124 is first set to the desired drying time, and assuming that switches 120 and 122 are closed, the start button 130 is pressed. Such latches relay 138 to supply power to the blower motor 54 and drum motor 18 as well as the timer motor 124*a*. The timer motor then proceeds to run until the desired drying time is up at which time the switch 124 is opened to remove the power from the transformer 114 and thus power to the magnetron 46. The time delay 134 maintains the switch 132 closed for a short while after the power to the magnetron is turned off so that the blower motor 54 and the drum motor 18 continue to operate for a specified time to insure that the magnetron is cooled.

Filament transformer 116 is connected across the input to the magnetron power supply derived from the auto/isolation transformer 114. A time delay device 146 is connected across the primary of transformer 116 and a pair of contacts 148 of such time delay are connected in series with the output of the transformer 114. Upon supplying power to the transformer 114 and thus to time delay 146, the latter provides a pre-set time delay to allow the magnetron filament 118 sufficient time to warm up before contacts 148 close allowing voltage to be supplied to the magnetron 46.

The power supply to magnetron 46 includes a bridge rectifier 150 connected in the output circuit of the transformer 114. The output of the rectifier is connected to a capacitor 152 and bleeder resistor 154 for generating a DC voltage at the top end of a pulse transformer 156 supplying pulsed power between the cathode 158 and the anode 159 of the magnetron. Conventional regulating means 160 for supplying DC power of the required value to control circuitry now to be described is included in the magnetron circuit.

The present invention includes protective circuits for the magnetron which operate through the use of pulse modulation of the magnetron. The magnetron is pulse modulated through the action of an electronic switch 164 connected to the primary of pulse transformer 156 (whose secondary is connected between the cathode 158 and the anode 159 of the magnetron) and arranged to rapidly open and close the circuit formed by the DC power supply and pulse transformer and a variable pulse width multivibrator 165 acting through AND gate 166 associated with other inputs to be described. In normal operation, the other inputs to the AND gate 166 are such that upon a pulse from multivibrator 165 switch 164 is closed thus providing through the transformer action and design of the pulse transformer 156 a pulse of power (of proper voltage, polarity, and current) to the anode of the magnetron and of the same duration as the pulse from multivibrator 165. With zero input to multivibrator 165 the pulse duration is such that the average power from the magnetron when operating into a matched load is the desired value; thus any decrease in pulse width will be reflected as a decrease in average output power. The switch 164 may be a switch which is electrically controllable and fast enough operating. Examples are Hex Fet and VMOSFet switches.

Figure 3:
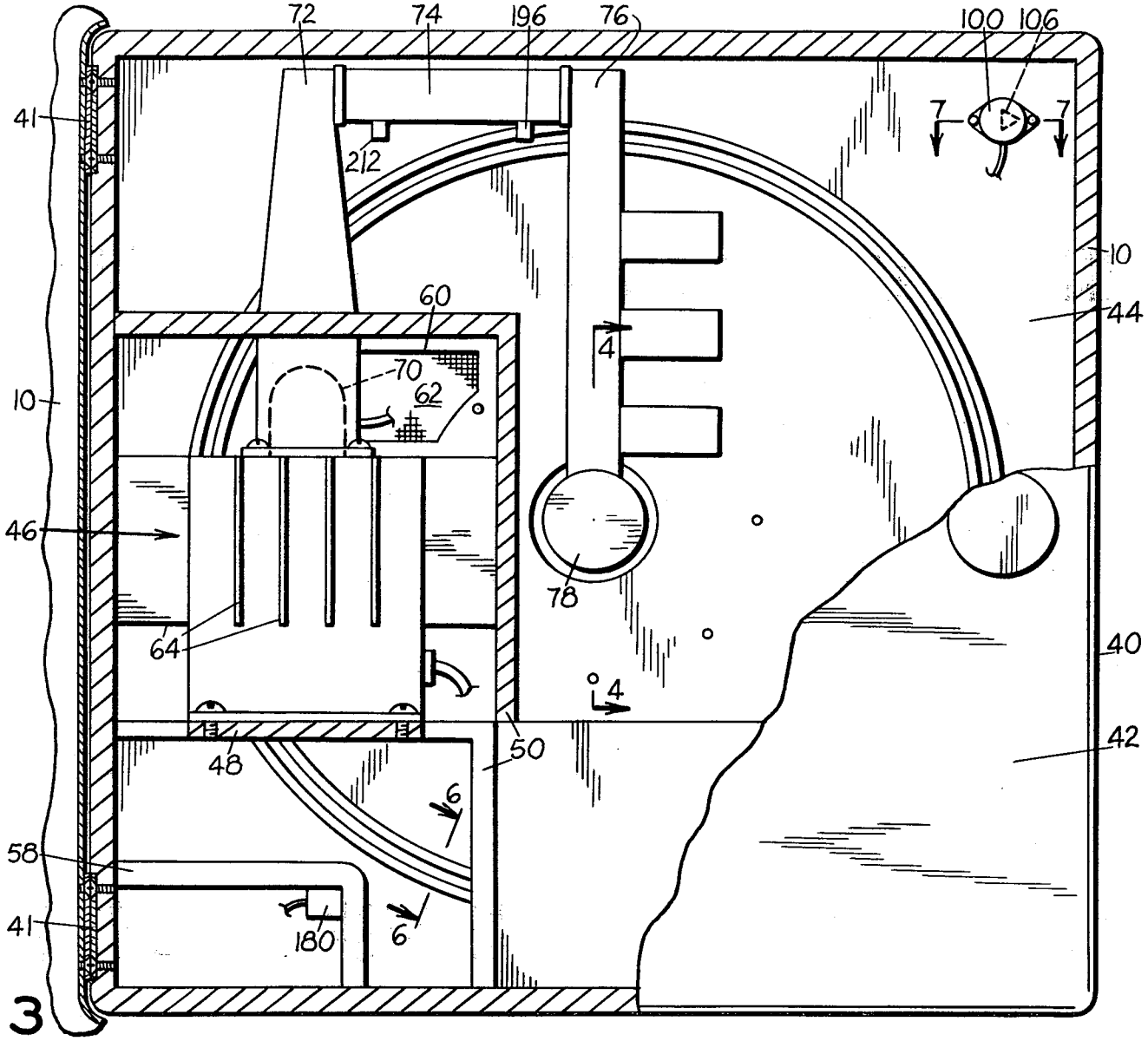
FIG. 3 is a fragmentary elevational view, partly broken away, taken on line 3—3 of FIG. 2.
Figure 1:
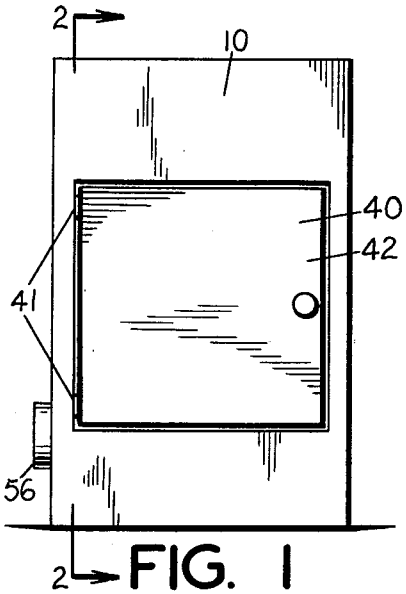
FIG. 1 is a front elevational view of apparatus with which the present invention may be employed.
Figure 7:
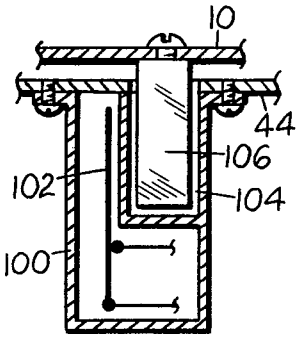
FIG. 7 is an enlarged fragmentary sectional view taken on the line 7—7 of FIG. 3.

A first protective circuit for the magnetron, designated generally by the numeral 170 includes a magnetron thermal protector switch 172 of conventional construction and various interlock switches such as the door interlock switch 102 shown in FIG. 7, door panel interlock switch 174, and other interlock switches 176.

Circuit 170 also includes a contact 179 operated by the relay 138 and acting as a control to the pulse modulator switch 164 along with the other switches in series therewith. Contact 179 serves as a direct turn-off for the magnetron as soon as the relay 138 is deenergized.

Also in the circuit 170 is humidity sensor means arranged to control operation of the switch 164 through the gate 166. Such sensor means comprises a first humidity sensor 180 located in the path of the inlet air to the clothes dryer, such as in the portion 58 or 60 shown in FIG. 3, and a second humidity sensor 182 located in the path of the outlet air of the dryer such as adjacent to the outlet 34 shown in FIG. 2. The outputs of the humidity sensors 180 and 182 are fed to the two inputs of a difference amplifier 184, and the output of such amplifier is fed to a comparator 186 which compares such output to a reference input 188. The system can be arranged such that when the output of the two humidity sensors becomes equal or differ by a specified amount, the output of the difference amplifier goes below the reference voltage and the comparator's output of the comparator 186 to an AND gate 190 whose other input is connected to a logic generator 192 and whose output is connected to the series chain of interlocks in the circuit 170 and can shut the magnetron off at the AND gate 166 associated with pulse modulator switch 164, the humidity sensing means in the circuit 170 serves to prevent articles in the drum from being overdried or at least dried to a specified amount.

In addition to the circuitry described, the pulse modulated magnetron as controlled through the pulse modulator electronic switch 164 allows the use of additional protective circuits to prevent the magnetron from being subjected to excessive reflected power. Such additional circuits can be operated through the AND gate 166 along with the circuit 170.

A first of such protective circuits comprises a circuit 194 arranged to sample the average reflected power in the transmission line or wave guide connected to the magnetron. Such circuit comprises a sensor 196 of conventional design and located in the directional coupler 74, for example, FIG. 3, and arranged to sample the reflected power in such coupler. Such sensor provides a signal proportional to the reflected power, and such signal is in turn averaged over a number of pulses by an integrator 198. The averaged signal from the integrator is then fed to one input of a difference amplifier 200 whose other input 202 is connected to a reference voltage. The output of amplifier 200 feeds into the variable pulse width multivibrator 165 connected to the AND gate 166. When the average reflected power signal exceeds a value determined by the reference, a signal is produced which is proportional to the amount that the average reflected power exceeds the reference level determined by the reference. The gain of the difference amplifier is sufficient enough that a small increase in the average reflected power above the reference will provide enough signal at the width control input to the pulse width multivibrator 165 so as to reduce the pulse width from its maximum value to a value such as to keep the average forward and hence the reflected power below its maximum allowable value. If the average reflected power should exceed a preset level as determined by reference voltage 202 and a regulating band determined by the gain of amplifier 200 and the voltage input required to reduce the pulse width of multivibrator 165 to zero, the pulse width of the pulse output of multivibrator 165 will become zero, thus turning completely off AND gate 166 and hence switch 164. This in turn deenergizes the magnetron.

Another protective circuit for the magnetron which operates through the AND gate 166 comprises a circuit 210 for protecting the magnetron from peak voltage standing wave ratios in excess of the source capabilities. Circuit 210 comprises a sensor assembly 212 in the transmission line such as in the directional coupler 74, FIG. 3, containing structure to sample and detect a signal which is proportional to the forward power. This signal along with the reflected power signal derived from sensor 196 is fed to an operational amplifier 214 hooked up so that its output is proportional to the ratio of the reflected power signal to the forward power signal and thus a measure of the voltage standing wave ratio in the transmission line connected to the magnetron. The output signal of the amplifier is fed to a comparator 216 whose other input 218 is connected to a reference voltage. When the signal from the ratio amplifier exceeds the reference voltage, the comparator's output opens the AND gate 166.

Circuit 210 as well as circuit 194 causes the magnetron to be turned off partially or completely only during the undesirable periods which if temporary will only amount to a momentary shut down. These circuits were designed to protect the magnetron from voltage standing wave ratios which may be in excess of the source capabilities such as may happen in the event that a metal object, for example, is in a load to the dryer. Although circuits 194 and 210 are shown herein in conjunction with a dryer mechanism employing a tumbler which presents articles to be dried to the output power of the magnetron, such circuits could as well be applied to other mechanisms such as conventional microwave ovens for protecting the magnetron from excessive average reflected or peak standing wave ratios.

Sensors 196 and 212 may comprise suitable and conventional sensing devices such as a diode rectifier which converts the RF energy provided by the directional coupler to a DC voltage.

Figure 9:
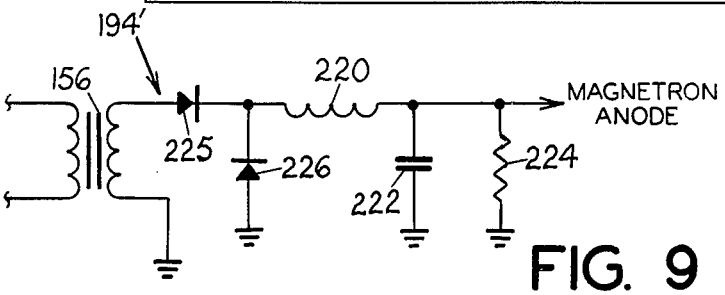
FIG. 9 is a schematic of a modified circuit which may be associated with the present mechanism.

FIG. 9 shows an alternative form of circuit 194' for controlling the average and peak reflected powers to the magnetron. In this circuit, the output from the pulse transformer 156 is connected to a rectifier filter so as to become a switching power supply. The integrator is eliminated and its function is solved by an inductor connected to a capacitor 222 and bleeder resistor 224. In this circuit a diode 225 acts as a rectifier whose output is connected to an LC filter comprised of inductor 220 and capacitor 222. Diode 226 acts as a commutating diode. In the circuit of FIG. 9, the magnetron power output is now controlled by anode voltage which decreases as the pulse width decreases.

It is to be understood that the forms of our invention herein shown and described are to be taken as preferred examples of the same and that various other changes in the shape, size and arrangement of parts may be resorted to without departing from the spirit of our invention, or the scope of the subjoined claims. For example, it is within the concept of the invention to mount the magnetron in the housing 10 rather than in the door, it merely being necessary as one example that an RF connection which is supplied by a flexible coaxial line extend from the magnetron in the housing to a suitably mounted wave guide.

Having thus described our invention, we claim:

1. Microwave treating mechanism for removing moisture from articles comprising (a) a hollow tumbler-type drum arranged to receive articles from which moisture is to be removed, (b) support means supporting said drum on substantially a horizontal axis, (c) drive means arranged to rotate said drum whereby articles being treated tumble across the interior of said drum, (d) microwave power means on said support means disposed with the output thereof directed in an axial direction into said drum for engaging articles tumbling across the rotating drum for removing moisture therefrom, (e) an electric circuit for said power means, (f) control means in said circuit for said power means, (g) and forced air means in said mechanism moving heated air through said drum for carrying away moisture within said drum, (h) said forced air means including air inlets into said support means and drum, (i) an air outlet from said drum, (j) and a passageway between said inlet and outlet (k) said passageway extending adjacent to said power means in an arrangement such that forced air that removes moisture from said drum cools said power means and said power means in being cooled causes said forced air to be heated before its entry into said drum to increase the vapor carrying capabilities of said forced air.

2. The microwave treating mechanism of claim 1 wherein said power means comprises a magnetron, said magnetron having outwardly projecting fins for cooling by said forced air.

3. Microwave treating mechanism for removing moisture from articles comprising (a) a hollow tumbler-type drum arranged to receive articles from which moisture is to be removed, (b) a housing supporting said drum for rotation on substantially a horizontal axis, (c) a door on said housing disposed adjacent to one end of said drum, (d) drive means arranged to rotate said drum whereby articles being treated tumble across the interior of said drum, (e) microwave power means on said housing disposed with the output thereof directed in an axial direction into said drum for engaging articles tumbling across said rotating drum for removing moisture therefrom, (f) an electric circuit for said power means, (g) control means in said circuit for said power means, (h) means on said door coupling energy from said microwave power means to said drum, (i) an RF gasket between said door and said housing arranged to choke off power from said microwave power means leaking through the joint between said housing and door, (j) a separate gasket of resilient material between said door and said housing to seal off the leakage of air through the joint between said housing and door, (k) and forced air means in said mechanism moving heated air through said drum for carrying away moisture within said drum.

4. Microwave treating mechanism for removing moisture from articles comprising (a) a hollow tumbler-type drum arranged to receive articles from which moisture is to be removed, (b) a housing supporting said drum on substantially a horizontal axis, (c) a door on said housing disposed adjacent to one end of said drum, (d) drive means arranged to rotate said drum whereby articles being treated tumble across the interior of said drum, (e) microwave power means on said door disposed with the output thereof directed in an axial direction into said drum for engaging articles tumbling across said rotating drum for removing moisture therefrom, (f) means for coupling energy from said microwave power means to said drum supported on said door, (g) choke means between said drum and housing arranged to choke off power from said microwave power means leaking through the joint between said drum and housing and thence to the exterior of said housing, (h) an electric circuit for said power means, (i) control means in said circuit for said power means, (j) and forced air means in said mechanism moving heated air through said drum for carrying away moisture within said drum.

5. Microwave treating mechanism for removing moisture from articles comprising (a) a hollow tumbler-type drum arranged to receive articles from which moisture is to be removed, (b) a housing supporting said drum on substantially a horizontal axis, (c) a door on said housing disposed adjacent to one end of said drum, (d) said drum having an opening facing said door, (e) drive means arranged to rotate said drum whereby articles being treated tumble across the interior of said drum, (f) microwave power means on said support means disposed with the output thereof directed in an axial direction into said drum for engaging articles tumbling across said rotating drum for removing moisture therefrom, (g) said door having means coupling the energy from said microwave power means to a cavity formed by said drum, (h) a dome-like shield transparent to microwaves mounted on said door and covering said coupling means, (i) said shield being of a size and shape to keep the tumbling articles being dried out of the near field of said coupling means, (j) an electric circuit for said power means, (k) control means in said circuit for said power means, (l) and forced air means in said mechanism moving heated air through said drum for carrying away moisture within said drum.

6. Microwave treating mechanism for removing moisture from articles comprising (a) a hollow tumbler-type drum arranged to receive articles from which moisture is to be removed, (b) support means supporting said drum on substantially a horizontal axis, (c) drive means arranged to rotate said drum whereby articles being treated tumble across the interior of said drum, (d) microwave power means on said support means disposed with its output directed in an axial direction into said drum for engaging articles tumbling across said rotating drum for removing moisture therefrom, (e) said power means comprising a magnetron, (f) said power means also comprising a cylindrical wave guide coupler directed into said drum, (g) said output and cylindrical wave guide coupler being connected by means of a wave path consisting of a transition section leading from said output for impedance matching, (h) a directional coupler leading from said transition section for providing signals proportional to forward and reflected power required by said control means, (i) a tuner between said directional coupler and said cylindrical wave guide coupler for impedance matching to the load presented by said drum, thus protecting said magnetron from excessive average reflected power and peak VSWR, (j) an electric circuit for said power means, (k) control means in said circuit for said power means, (l) and forced air means in said mechanism moving heated air through said drum for carrying away moisture within said drum.

7. Microwave treating mechanism for removing moisture from articles comprising (a) a hollow tumbler-type drum arranged to receive articles from which moisture is to be removed, (b) support means rotatably supporting said drum, (c) drive means arranged to rotate said drum, (d) microwave power means on said support means disposed with the output thereof directed into said drum for engaging articles in said drum upon rotation of the latter for removing moisture therefrom, (e) an electric circuit for said power means, (f) control means in said circuit for said power means, (g) and forced air means in said mechanism carrying away moisture from said drum, (h) said forced air means including air inlets into said support means and drum, an air outlet from said drum, and a passageway between said inlets and outlet, (i) said passageway extending adjacent to said power means in an arrangement such that forced air that removes moisture from said drum cools said power means and said power means in being cooled causes said forced air to be heated before its entry into said drum to increase the vapor carrying capabilities of said forced air.

* * * * *